US005287810A

United States Patent [19]

Aumasson et al.

[11] Patent Number: 5,287,810

[45] Date of Patent: Feb. 22, 1994

[54] CARRIER SHELL EJECTING A PAYLOAD BY MEANS OF A PISTON

[75] Inventors: Régis Aumasson; Dominique Dion, both of Bourges, France

[73] Assignee: Giat Industries, Versailles, France

[21] Appl. No.: 972,842

[22] Filed: Nov. 6, 1992

[30] Foreign Application Priority Data

Nov. 6, 1991 [FR] France ..... 91 13673

[51] Int. Cl.[5] ..... F42B 12/62

[52] U.S. Cl. ..... 102/489; 102/357

[58] Field of Search ..... 102/357, 351, 342, 340, 102/338, 393, 489, 504, 386; 89/1.701

[56] References Cited

U.S. PATENT DOCUMENTS

| | | | |
|---|---|---|---|
| 854,624 | 5/1907 | Banks | 102/504 |
| 2,274,655 | 3/1942 | Bickel | 102/504 |
| 2,973,712 | 3/1961 | Sekella et al. | 102/378 |
| 3,092,358 | 6/1963 | Potts et al. | 102/357 |
| 3,771,417 | 11/1973 | Schnabele et al. | 102/1.701 |
| 4,294,172 | 10/1981 | Rauschert et al. | 102/357 |
| 4,889,053 | 12/1989 | Grosswendt et al. | 102/340 |
| 5,042,389 | 8/1991 | Sabranski et al. | 102/489 |
| 5,160,800 | 11/1992 | Travor et al. | 102/357 |

FOREIGN PATENT DOCUMENTS 2363077 3/1978 France .

*Primary Examiner*—David H. Brown

*Attorney, Agent, or Firm*—Oliff & Berridge

[57] ABSTRACT

The invention relates to carrier shells which can eject a payload in flight. A carrier shell for transporting a payload includes a body closed at one of its ends by a base and at the other by a head, inside of which is placed a pyrotechnic composition for generating gases intended to act on a piston at the time the payload is ejected. The shell includes an attachment between the piston and the shell after ejection of the payload. This invention is applicable to mine-dispersing carrier shells.

10 Claims, 6 Drawing Sheets

CARRIER SHELL EJECTING A PAYLOAD BY MEANS OF A PISTON

BACKGROUND OF THE INVENTION

The technical field of this invention is that of carrier shells carrying a payload, for example one or more submunitions, and ejecting said payload in flight by means of a piston pushed by gas pressure.

Such a shell contains, in a known manner, a body provided at the rear with a band. A head and a base are threaded onto the front and rear ends, respectively, of the body. The interior of the body has a payload composed, for example, of at least one submunition. Housed in the tip of the head is a dispensing charge that can be ignited by a fuze.

Upon expiration of a time that is programmed before firing, the fuze ignites the dispensing charge which causes a gas pressure. The latter axially pushes a piston, which displaces the payload and the base in order to eject them from the shell.

One such type of carrier shell is described, for example, in French patent FR 2,363,077.

These carrier shells pose problems in terms of separation between the payload and the piston.

Specifically, the piston must decouple from the payload after ejection of the payload, but without disturbing its trajectory.

SUMMARY OF THE INVENTION

An object of this invention is to provide a carrier shell, containing a payload pushed by a piston, that can avoid the drawbacks described above.

This invention is directed to a carrier shell intended to transport a payload, comprising a body closed at one of its ends by a base and at the other by a head inside which is placed a pyrotechnic composition for generating gases intended to act on a piston at the time the payload is ejected, the shell containing means providing an attachment between the piston and the shell after ejection of the payload.

The presence of such means makes it possible to decouple the piston from the payload.

BRIEF DESCRIPTION OF THE DRAWINGS

The invention will be better understood after reading the description of specific embodiments given with reference to the attached drawings wherein.

DETAILED DESCRIPTION OF PREFERRED EMBODIMENTS

According to one particular embodiment of this invention, the attachment means comprise at least one cable, one end of which is coupled to the shell at the head, and the other end of which is coupled to a spool fastened to the piston, said cable being wound onto the spool.

According to a variant of the invention, the axis of the spool is offset relative to the axis of the shell, which prevents interference between the piston and the payload in the event the cable breaks.

Figure 5:
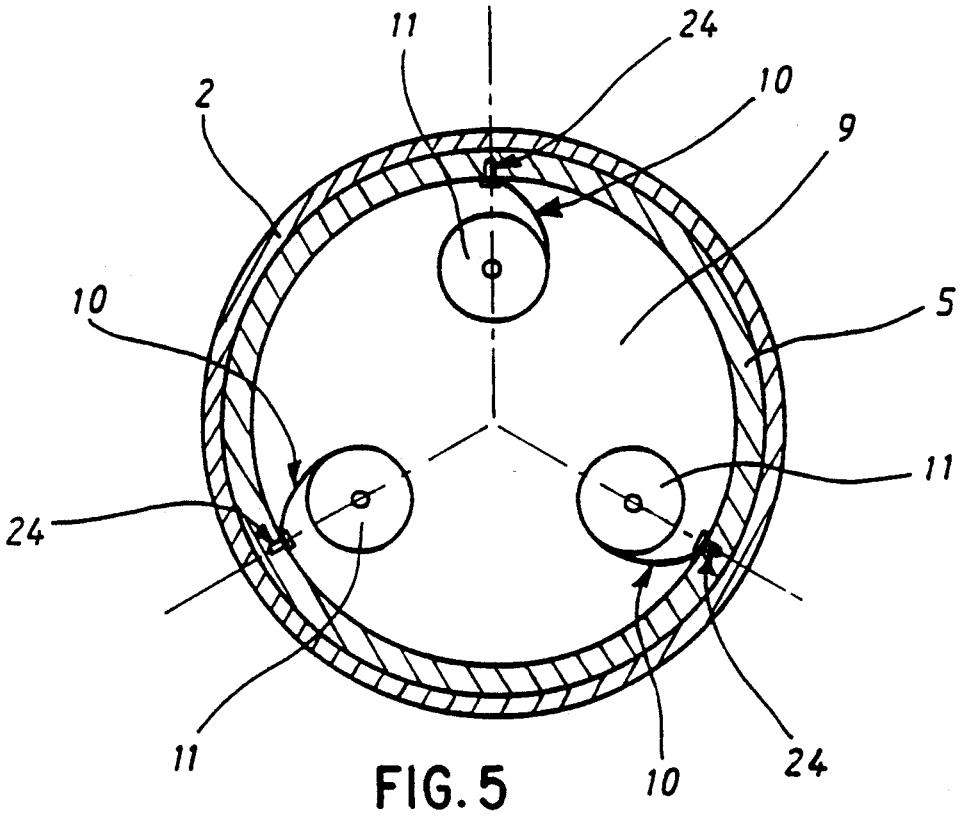
FIG. 5 schematically depicts, in a cross section, the same carrier shell according to a preferred embodiment.
Figure 7:
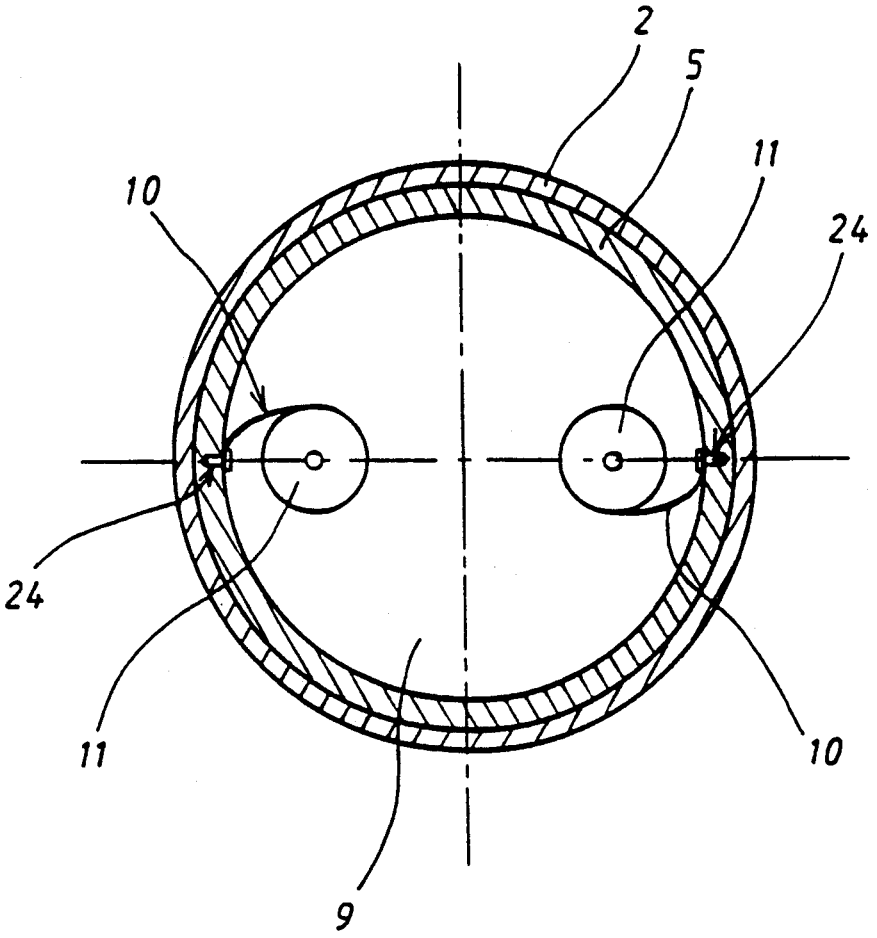
FIG. 7 schematically depicts, in a cross section, the same carrier shell according to a preferred embodiment.

According to another variant, the shell possesses at least two cables wound onto at least two spools distributed at regular angular intervals on the piston (see FIGS. 5 and 7).

Figure 6:
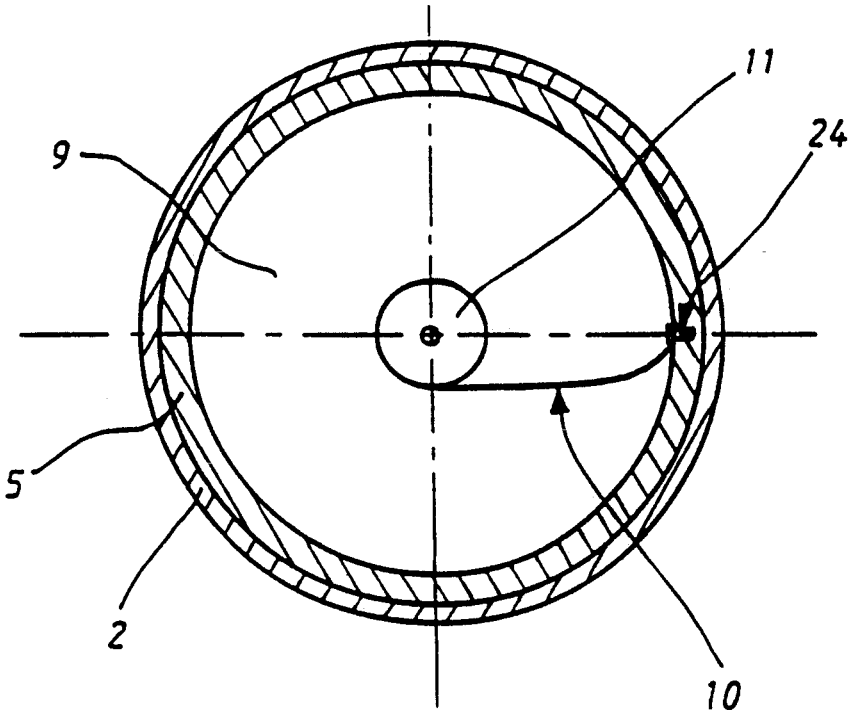
FIG. 6 schematically depicts, in a cross section, the same carrier shell according to a preferred embodiment.

According to another variant, the axis of the spool is identical to the axis of the shell (see FIG. 6).

The spool or spools can consist of one or more cylindrical extensions of the piston.

Figure 4:
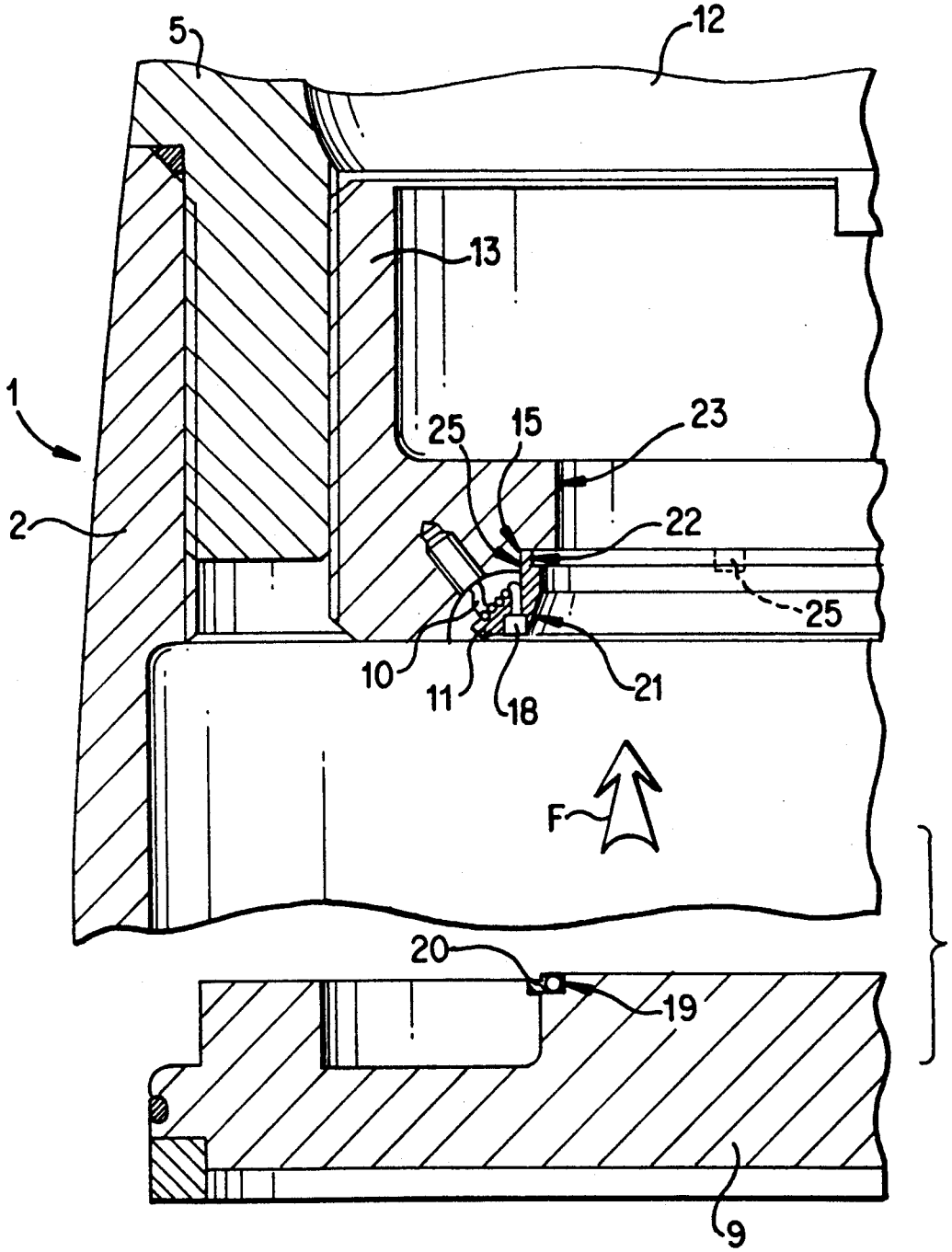
FIG. 4 schematically depicts, in partial axial section, the same carrier shell according to a preferred embodiment.

According to an advantageous embodiment, the spool is retained in a temporary manner, for example by a spot of glue, on a countersink present on a collar coupled to the head, the piston having means allowing it to be held on the spool (see FIG. 4).

The means by which the piston is held on the spool can comprise a deformable flexible ring placed in a groove of the piston.

Preferably, the spool will have a conical profile intended to cause compression of the flexible ring in its groove when the piston is put in place, as well as an undercut intended to receive the flexible ring which thus couples the piston to the spool.

Figure 1:
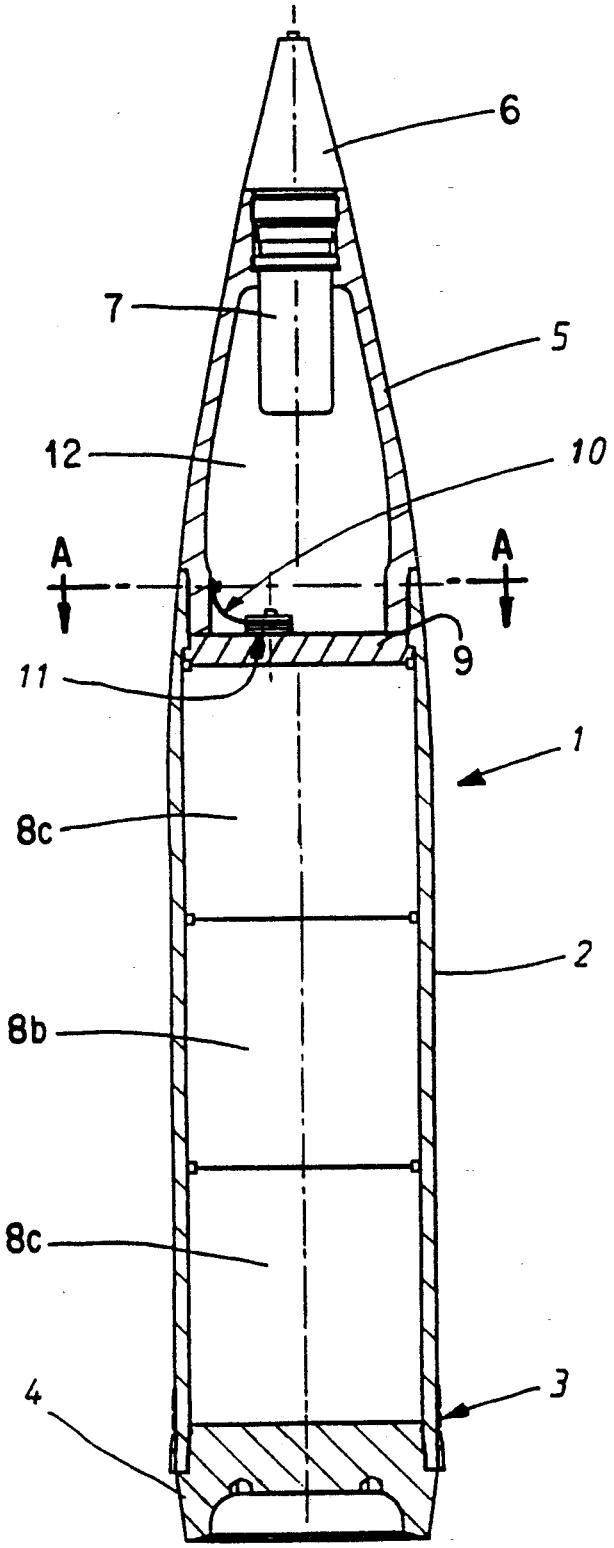
FIG. 1 schematically depicts, in axial section, a carrier shell carrying submunitions pushed by a piston according to the invention.

Referring to FIG. 1, a carrier shell 1 comprises in conventional fashion a body 2 provided at the rear with a band 3. A base 4 is threaded onto the rear end of body 2, while a head 5 is threaded onto the front end. Head 5 has an electrical or mechanical timer fuze 6 intended to ignite a gas-generating pyrotechnic composition 7.

Placed inside body 2 is a payload, comprising in this case three submunitions 8*a*, 8*b*, and 8*c*, for example, dispersible mines.

The submunitions are caused to rotate together with the body of the carrier shell by means such as pins or keys. A piston 9 rests at one end against submunition 8*c*, and at the other end against the rear end of head 5, thus defining inside the latter a chamber 12.

Piston 9 is attached to the carrier shell at head 5 by an attachment means which in this case is a steel cable 10 approximately one millimeter in diameter. One end of cable 10 has a loop which is fastened to head 5 by means of a screw (only the axis of which is depicted here).

The other end of the cable is fastened to a winding spool 11, the axis of which is coupled to the piston by another screw. The cable is wound onto the spool when the shell is assembled.

When gas-generating composition 7 is ignited by fuze 6, a very high gas pressure is generated in chamber 12. This pressure causes a substantial thrust on piston 9, which in turn pushes submunitions 8 and base 4, thus shearing off the screw thread which retains the latter on body 2.

Figure 2:
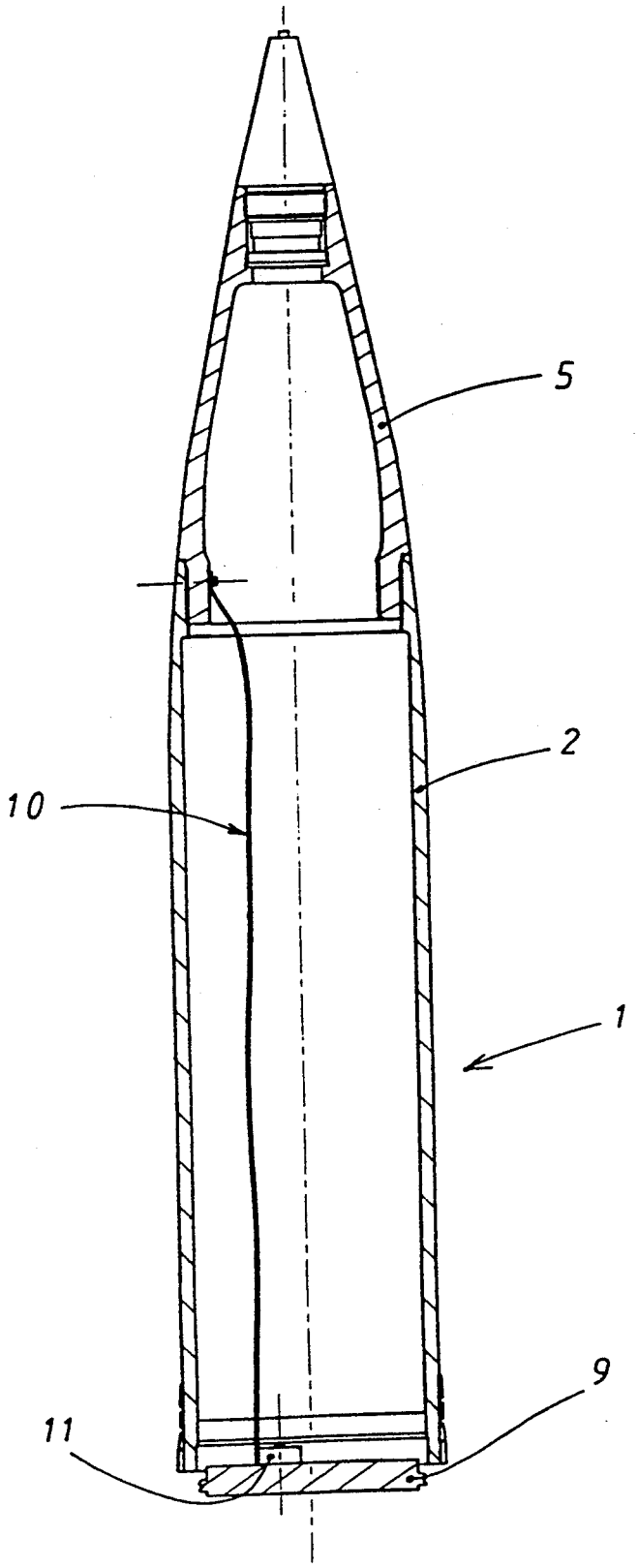
FIG. 2 schematically depicts, in axial section, the same carrier shell after ejection of the submunitions.

Base 4 is thus ejected first, followed by first submunition 8*a*, second 8*b*, and third 8*c*. Piston 9, which is attached to carrier shell 1 by cable 10 connected to head 5, decouples from submunition 8*c*, allowing the latter to continue its trajectory without disruption (see FIG. 2).

The length of cable 10 is determined on the basis of the length of body 2 to ensure ejection of the last submunition 8c. It will therefore be at least equal to the length of carrier shell body 2.

In this case the axis of spool 11 is offset with respect to the axis of carrier shell which allows piston 9 to be ejected laterally away from the trajectory of the shell in the event cable 10 breaks. This prevents any interference with the last submunition 8c that is ejected.

To increase the mechanical strength of the attachment, it is possible to provide a plurality of cables 10, each wound onto a spool fastened to piston 9. The spools will be distributed at regular angular intervals on the piston so as to prevent any imbalance.

To prevent breakage of the cable or cables, braking means are preferably placed between the payload and the shell body, or between the piston and the shell body. Such braking means are disclosed in copending, commonly assigned U.S. application Ser. No. 07/972,847, pending filed Nov. 6, 1992.

Figure 3:
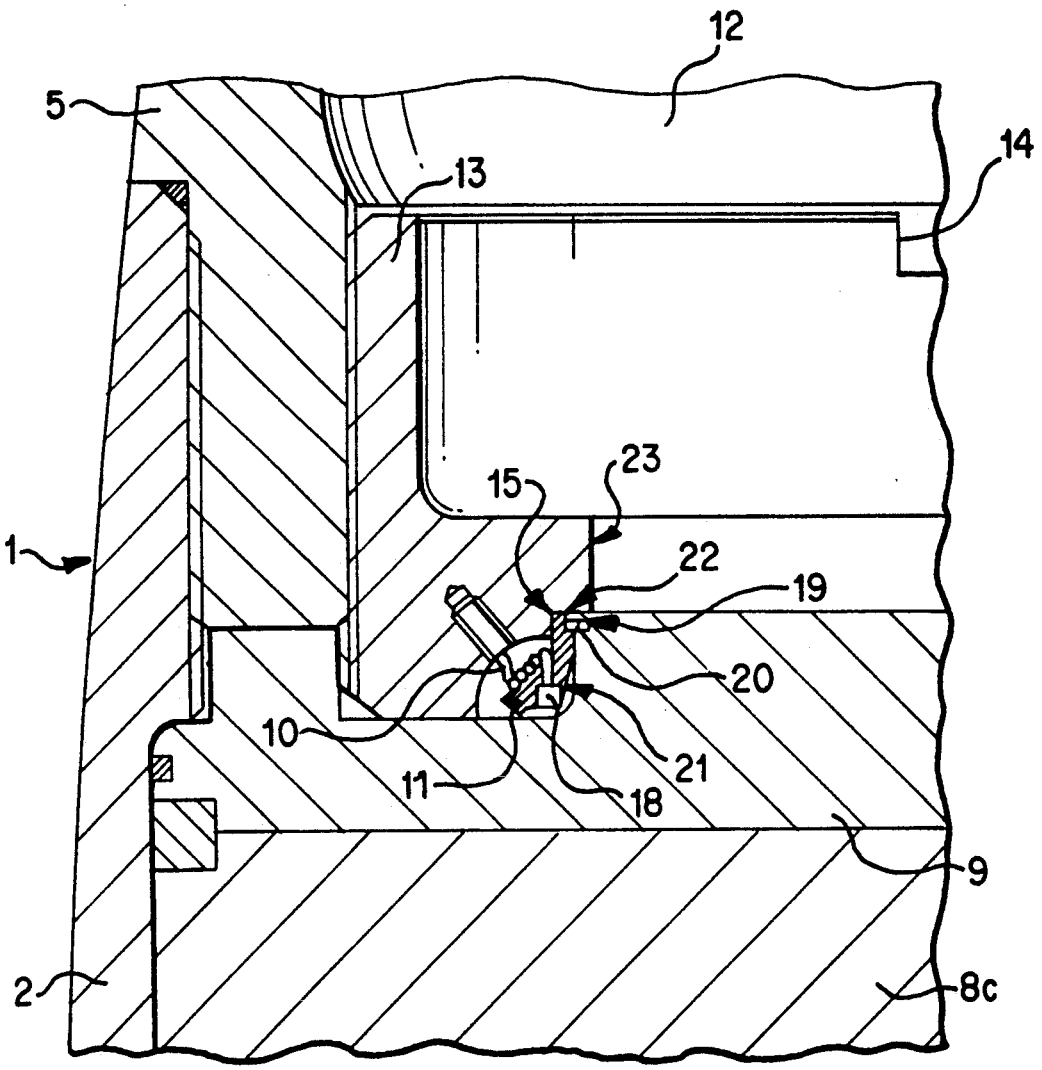
FIG. 3 schematically depicts, in partial axial section, the same carrier shell according to a preferred embodiment.

According to a preferred embodiment, referring to FIG. 3, carrier shell 1 contains a collar 13 threaded onto head 5 and intended to take up the axial assembly clearance of the stack of submunitions 8a, 8b, 8c. The collar has a hole 23 which allows the gases of pyrotechnic composition 7 to pass towards piston 9.

Collar 13 is threaded on through the opening in head 5 intended to receive fuze 6, using notches 14 made on the upper face of the collar.

The rear face of collar 13 has a countersink 15 intended to receive, in a slightly sliding manner, the end of a spool 11. Wound onto said spool 11 is a cable 10, one of whose ends has a crimped head 18 which fits into a receptacle of complementary shape arranged on spool 11, and couples the latter to the cable.

The other end of the cable is crimped in a threaded sleeve which in turn is attached in a threaded manner to collar 13.

Piston 9 has a groove 19 in which is installed a flexible ring 20, the function of which will be described later.

Spool 11 possesses a conical profile 21 with which, during assembly, ring 20 can be elastically compressed into its groove 19. After conical profile 21 has passed, ring 20 projects into an undercut 22 on spool 11.

This sub-assembly may be installed as follows:

Spool 11, with cable 10 wound on it, is mounted inside countersink 15 of collar 13 by adding a few spots of glue to hold it in place.

Head 5, with collar 13 on it, is screwed onto body 2.

Piston 9, fitted with flexible ring 20, is installed inside body 2.

Piston 9 is pushed until flexible ring 20 comes into contact with spool 11, is compressed into its groove 19 by conical profile 21, and then is projected into undercut 22.

Spool 11 is thereby coupled to piston 9.

When pyrotechnic composition 7 is ignited by fuze 6, a very high gas pressure is generated in chamber 12. This pressure causes considerable thrust on piston 9 through passthrough hole 23 in collar 13. The piston in turn pushes submunitions 8 and base 4.

Displacement of piston 9, to which spool 11 is coupled by means of flexible ring 20, causes detachment of the spots of glue which were attaching the spool to collar The base is ejected first, followed by first submunition 8a, second 8b, then third 8c. Piston 9, which is attached to carrier shell 1 by cable 10 fastened to collar 13, decouples from submunition 8c, leaving the latter to continue its trajectory without disruption.

We claim:

1. A carrier shell for transporting and ejecting a payload, comprising a body closed at one end by a base and at another end by a head; a piston; and a means for providing an attachment between the piston and the carrier shell after ejection of the payload, wherein said means for providing an attachment between the piston and the carrier shell after ejection of the payload comprises at least one cable, wherein one end of the at least one cable is coupled to the carrier shell at the head and another end is coupled to at least one spool fastened to the piston, the at least one cable being wound onto the spool.

2. A carrier shell according to claim 1, wherein the head comprises a pyrotechnic composition for generating gases intended to act on the piston at the time the payload is ejected.

3. A carrier shell according to claim 1, wherein the at least one spool has an axis offset relative to an axis of the shell.

4. A carrier shell according to claim 1, wherein the attachment comprises at least two cables wound onto at least two spools distributed at regular angular intervals on the piston.

5. A carrier shell according to claim 1, wherein the at least one spool comprises at least one cylindrical extension of the piston.

6. A carrier shell according to claim 1, wherein the at least one spool has an axis identical to the axis of the shell.

7. A carrier shell according to claim 6, wherein the head is coupled to a collar having a countersink, the at least one spool is held on the countersink by a means which will separate the at least one spool and the countersink when the piston is displaced, and the piston is held on the at least one spool.

8. A carrier shell according to claim 7, wherein the at least one spool is glued on the countersink.

9. A carrier shell according to claim 7, wherein the piston is held on the at least one spool by a deformable flexible ring in a groove of the piston.

10. A carrier shell according to claim 9, wherein the at least one spool has a conical profile for causing compression of the flexible ring in the groove of the piston when the piston is put in place, and has an undercut for receiving the flexible ring, whereby the piston and the at least one spool are coupled together.

* * * * *